United States Patent [19]

Loughrin

[11] Patent Number: 4,874,621

[45] Date of Patent: Oct. 17, 1989

[54] PACKAGING METHOD AND SYSTEM FOR EDIBLE SOLID FATS AND THE LIKE

[75] Inventor: Thomas D. Loughrin, Medina, Ohio

[73] Assignee: Durkee Industrial Foods Corporation, Cleveland, Ohio

[21] Appl. No.: 10,617

[22] Filed: Feb. 4, 1987

[51] Int. Cl.[4] ..... B65B 3/17; B65D 77/06; B65D 85/74

[52] U.S. Cl. ..... 426/124; 426/126; 426/130; 426/411; 426/413; 426/115; 220/403; 53/440; 53/449; 383/904; 383/906; 383/113

[58] Field of Search ..... 426/411, 413, 414, 130, 426/112, 115, 124, 126, 127; 220/403, 410; 53/449, 440, 122, 175

[56] References Cited

U.S. PATENT DOCUMENTS

| | | | |
|---|---|---|---|
| 2,065,182 | 12/1936 | Harris | 426/413 |
| 2,127,401 | 8/1938 | Gillican | 226/47 |
| 2,352,503 | 6/1944 | Walton | 220/403 |
| 2,383,352 | 8/1945 | Snyder | 99/178 |
| 2,424,693 | 7/1947 | Jones | 426/414 |
| 2,471,867 | 5/1949 | Fisher et al. | 426/414 |
| 2,920,967 | 1/1960 | Heinemann | 99/171 |
| 2,950,037 | 8/1960 | Orsini | 220/403 |
| 3,007,608 | 11/1961 | Cox, Jr. | 222/105 |
| 3,143,249 | 8/1964 | Merrill et al. | 220/410 |
| 3,169,690 | 2/1965 | Scholle | 220/403 |
| 3,200,603 | 1/1967 | Shaw | 53/22 |
| 3,242,951 | 3/1966 | Curie et al. | 141/350 |
| 3,314,210 | 4/1967 | Jarund | 53/27 |
| 3,427,646 | 2/1969 | Scholle | 220/410 |
| 3,539,360 | 11/1970 | Woods | 220/403 |
| 4,085,244 | 4/1978 | Stillman | 426/126 |
| 4,284,672 | 8/1981 | Stillman | 426/126 |
| 4,309,466 | 1/1982 | Stillman | 426/127 |
| 4,360,996 | 11/1982 | Rutter | 53/469 |
| 4,386,636 | 6/1983 | Ellert | 141/10 |
| 4,421,253 | 12/1983 | Croley | 220/410 |
| 4,454,945 | 6/1984 | Jabarin et al. | 426/411 |
| 4,558,801 | 12/1985 | Vilutis | 426/411 |
| 4,610,885 | 9/1986 | Tait | 426/411 |

FOREIGN PATENT DOCUMENTS

| | | | |
|---|---|---|---|
| 3016466 | 11/1980 | France | 220/403 |
| 2483893 | 12/1981 | France | 220/403 |

*Primary Examiner*—Steven Weinstein
*Attorney, Agent, or Firm*—Tarolli, Sundheim & Covell

[57] ABSTRACT

The present invention relates to packaging edible solid fats, and more particularly to a two-piece packaging system comprising an outer casing of container or similar rigid material, defining the overall shape of the package, and an inner sealed bag of a thin, flexible packaging material. In the practice of the present invention, the fats are heated to a molten state, introduced into the inner sealed bag, and allowed to cool and harden in the bag.

13 Claims, 4 Drawing Sheets

PACKAGING METHOD AND SYSTEM FOR EDIBLE SOLID FATS AND THE LIKE

TECHNICAL FIELD

The present invention relates to packaging edible solid fats, or the like, and more particularly to a two-piece packaging system comprising an outer shipping container of corrugated board or similar rigid material, defining the overall shape of the package, and an inner sealed bag of a thin, flexible packaging material. In the practice of the present invention, the fats, or like compositions, are heated to a molten state, introduced into the inner sealed bag, and allowed to cool and harden in the bag while confined by the shipping container.

The present invention will be particularly described with respect to packaging solid vegetable fats intended for human consumption or use, such as for foods, pharmaceuticals and cosmetics, although it will be apparent to those skilled in the art that the present invention has other applications, for instance, packaging of other molten products such as hard cheeses, rosin, and the like.

BACKGROUND OF THE PRESENT INVENTION

The conventional method for packaging hard butter and other hard fats is to use a substantially square container into which a polyethylene bag or liner, having a wide mouth similar to a garbage bag, is placed. The bag or liner is filled with molten fat, up to a level near the top of the container, and when filling is stopped the remainder of the bag is folded down onto the top of the molten fat layer and the container is closed, cooling and solidification then taking place.

One problem with this is that orienting such a bag or liner vertically within a confining structure causes the bag or liner to develop folds or creases, particularly vertical folds, which tend to become imbedded in the fat during hardening. This also occurs due to parts of the bag being folded over onto the layer of molten fat during closing of the container. The fat tends to set up in the bag like cement, making it necessary for the end user, such as an employee of candy company, to actually chip away at the fat to remove imbedded liner. This is both time consuming and wasteful of fat, and the end user, such as a candy manufacturer, has to employ extreme care to prevent pieces of bag or liner from flowing into the end product being manufactured. Although filters are usually employed in the manufacture of most end products of the type contemplated, frequent cleaning of the filters is required, adding to manufacturing costs.

Another problem is that conventional polyethylene bags or liners fail to adequately protect the fats from moisture and air penetration during storage, shortening the shelf life of the fat. Depending upon product, a normal shelf life of fats may be as little as 2–3 months with conventional packaging.

Another method for packaging hard fats and butters is to use a simple plastic pail into which the molten fat is disposed. One problem with this is that the fats tend to leach polymers from the container, adversely affecting the flavor and shelf life of the fat product being stored. Also, removal of product from such a pail is difficult, generally requiring the application of heat, which adds to the costs involved.

Many other forms of packaging of molten and liquid materials have been proposed. For instance, U.S. Pat. No. 2,127,401 to Gillican, describes a packaging system for rosin. During packaging, the rosin is maintained in a molten condition at a temperature of 150°–350° F., and it is poured into a bag which is disposed in a supporting frame. Before the rosin cools and solidifies to any substantial extent, the bag is removed from the frame and placed on one of its broad sides. It is indicated in the patent that the bag, while in the frame, tends to develop wrinkles which crease and deform. If the rosin solidifies while the bag is in this configuration, the irregularities in the bag form lines of cleavage which make it easy for pieces of the rosin to break off during handling. Also, there is said to be a tendency in creases and fold areas for the rosin to soak into the bag, which on solidification makes it difficult for the bag to be removed. The bag is a conventional paper bag, which would not be suitable for use with molten fats. Also, the bag is, when placed in the supporting frame, provided with an open top used for filling, which, after filling, is sealed. The procedure in the Gillican patent also differs from the present invention in that the bag, once placed on a broad side, is not confined by any retaining structure.

Prior U.S. Pat. No. 2,383,352 to Snyder, describes a packaging system said to be suitable for packaging such products as lard, margarine and processed cheese, wherein the same may be placed into a bag in a hot, plastic condition and allowed to cool and set while contained in the bag. Cooling and solidifying can take place while the bag is retained in a box, the bag then being removed from the box by inverting the box. The bag is said to be an air-tight lining of rubber hydrochloride film (col. 4 of the patent). The box is not a shipping carton, nor does solidification take place while the bag is on a broad side.

Patents directed to bags having filler nozzles on a broad side thereof are U.S. Pat. Nos. 3,242,951 to Curie et al; 4,360,996 to Rutter; and 4,386,634 to Ellert. Other than use of a nozzle on a broad side of the bag, the disclosures of these patents do not relate to the concepts of the present invention. Also of interest in the prior art are U.S. Pat. Nos. 2,920,967 to Heinemann; 3,007,608 to Cox, Jr.; 3,299,603 to Shaw; and 3,314,210 to Jarund. These patents disclose primarily methods for packaging liquids.

BRIEF DESCRIPTION OF THE PRESENT INVENTION

The present invention resides in a packaging method and system particularly suitable for meltable products, comprising; providing a rectangular or square bag having opposed broad sides, including a support side and a fill side, edges continuously sealed together along the periphery of said sides, and a fill nozzle on said fill side; filling said bag through said fill nozzle with molten solid product to a predetermined amount and closing said fill nozzle; placing said filled bag in a supporting frame on its support side either before filling or after filling but while said product is in a molten state, said frame having side and end walls adapted to confine said bag edges, said filled bag defining a pillow or pillow-like configuration in said frame; and allowing said molten product to cool and solidify while so confined.

The present invention is particularly suitable for use with hard fats such as hard butters. Preferably, for this use, the bag is impervious to the passage of moisture and air, and more preferably is a two-ply bag having an inner ply or layer of low-density polyethylene, and an outer ply or layer of a metal foil laminated to a polyester film. In this respect, the shelf life of products packaged by the present invention is more than doubled.

In the present application, the term "meltable products" means compositions or materials such as hard fats which are normally solid at room or ambient temperature (e.g., about 70° F.) and can be made liquid with the application of heat. Not included are products which require heat for melting in excess of that compatible with the packaging materials of the present invention. For instance, with the above-mentioned bag construction, a maximum fill temperature is about 130° F.

Also, the term "molten" shall be deemed to include products which are in a semi-cooled, although still pliable or plastic, partially molten state, as well as those which are fully liquid. Frequently, particularly in the case of hard fats and hard butters, it is a practice to force cool the product in a heat exchanger such as a swept-wall heat exchanger, prior to extruding the product into suitable packaging, to develop a desired crystalline structure. Extrusion temperature can be by way of example, about 76° F.–90° F. in the case of hard fats and hard butters. As long as the products are sufficiently pliable on extrusion so that they adopt a shape defined in part by the confining frame, they are for the purposes of the present application deemed to be still molten.

In a preferred embodiment of the present invention, the supporting frame is a shipping carton having side, end, top and bottom confining walls or sides dimensioned to securely hold said pillow configuration.

The shipping container is preferably of corrugated board, to permit stacking.

BRIEF DESCRIPTION OF THE DRAWINGS

The invention and the advantages thereof will become more apparent upon consideration of the following specification, with reference to the accompanying drawings, in which.

DETAILED DESCRIPTION OF THE PRESENT INVENTION

Figure 1:
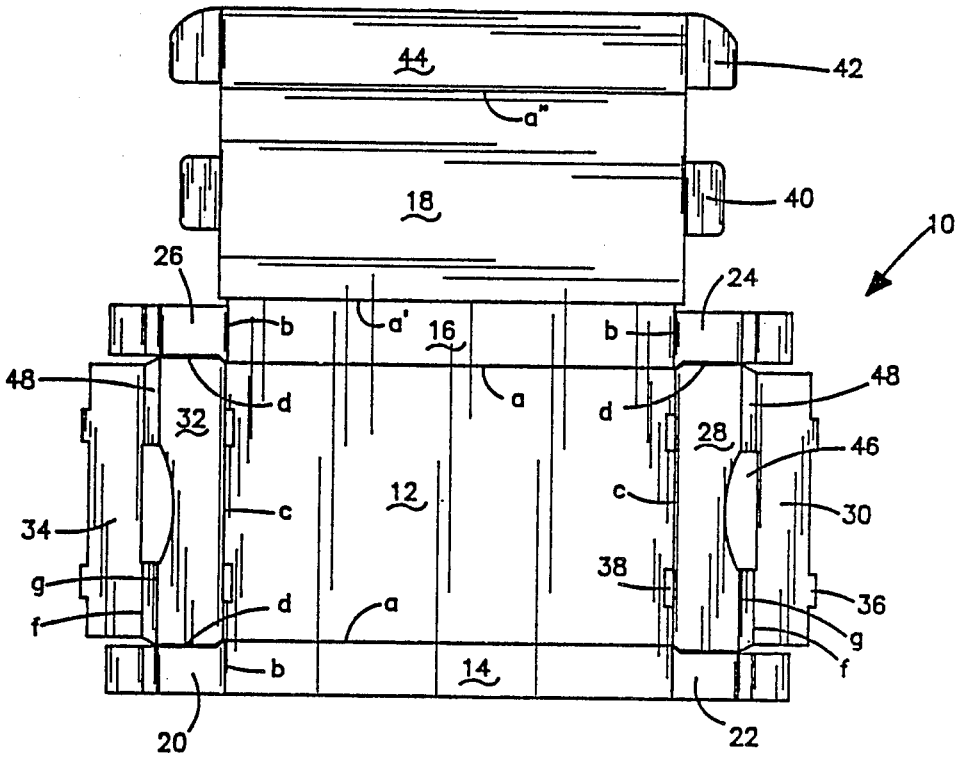
FIG. 1 is a plan view of a container blank from which a shipping container of the present invention is assembled.
Figure 2:
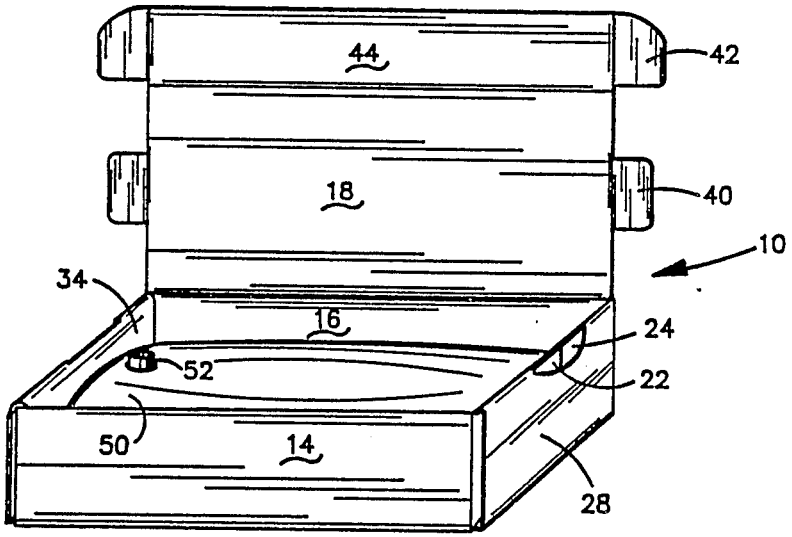
FIG. 2 is an assembled perspective view of the container of FIG. 1 showing a filled bag positioned within the container.

Referring to FIGS. 1 and 2, the container 10 of the present invention comprises a rectangular bottom part 12, sides 14 and 16 connected to the long edges of the bottom part 12, and ends 28 and 32 connected to the short edges of the bottom part. The sides 14 and 16, and ends 28 and 32 are connected to the bottom part along fold lines a and c, respectively. A top part 18 of about the same dimensions as the bottom 12, is hinged to side 16 along fold line a′ and a front flap 44 in turn is hinged to the top 18 along fold line a″, parallel to fold line a′.

The ends 28 and 32 have flaps 30 and 34 connected to them by bridge portions 48 connected along parallel fold lines f and g. The flaps 30 and 34 are provided with spaced apart tabs 36, as shown Finally, the container construction is provided with tabs 20, 22, 24 and 26 connected to the short ends of sides 14 and 16 along fold lines b. Cut lines b separate the tabs 20, 22, 24 and 26 from ends 28 and 32.

Figure 4:
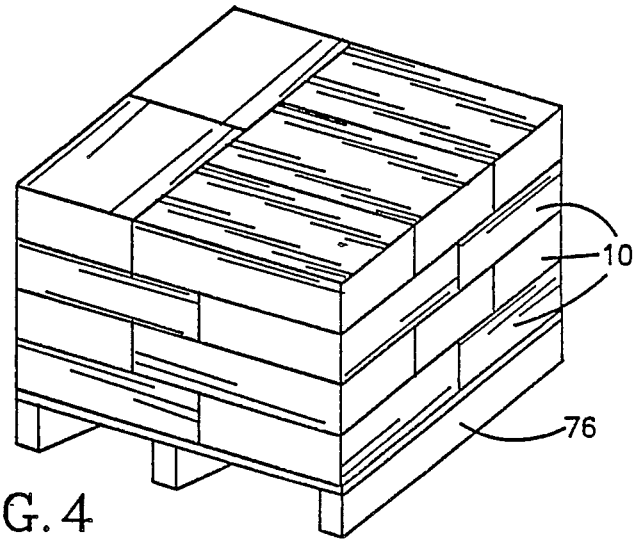
FIG. 4 is a perspective view showing the shipping containers of the present invention in stacked form.

To assemble the container, the sides 14 and 16 are folded up along fold lines a to right angles to the bottom 12. Tabs 22–26 are folded inwardly along fold lines b at right angles to the sides, this being permitted by the cut lines d. Ends 28 and 32 are folded upwardly along fold lines c at right angles to the bottom to lie against the tabs 20, 22, 24 and 26. At this point, the flaps 30 and 34 are folded downwardly over the tabs 22–26 and locked into place with locking tabs 36 engaging slots 38 positioned in the bottom 12. This provides a triple-ply, end wall construction which adds strength, a desirable or preferred construction for stacking the containers on a pallet as shown in FIG. 4.

Also shown in FIGS. 1 and 2 are windows or cutouts 46 in the end panels 28 and 32. These windows function to provide access by which the ears 40 can engage the container side walls. When the cover 18 is folded downwardly parallel to the bottom 12, the ears 40 fit through these windows into the space between the folded-up tabs 22–26 and end panels 28 and 32 (provided by the dimensions of the bridge portions 48 between the end panels 28 and 32 and the respective tabs). This construction is more clearly shown in FIG. 2. On the right-hand side, end panel 28 is visible defining the outer side of the container, and on the left-hand side, end flap 34 is visible defining the inner side of the container. Referring to the right-hand side, the two tabs 22 and 24 are visible through the window 46. These tabs lie between the end panel and inner lying flap 30. When the top 18 is lowered into covering position, the ears 40 fit through the window and slide into position between tabs 22 and 24 and end panel 28. Similarly, the ears 42 slide in from the front of the container into spacing between the tab 22 and end panel 28 (referring to the right-hand side). This procedure is duplicated on the left-hand side of the container.

Figure 3:
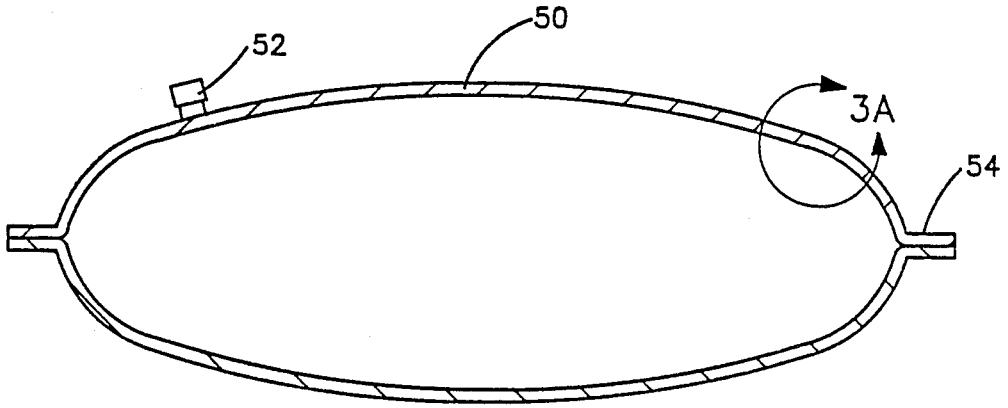
FIG. 3 is a section view of the filled bag.
Figure 3A:
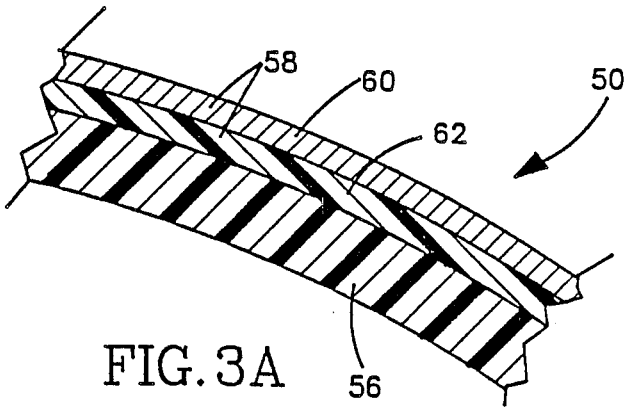
FIG. 3A is an enlarged section view of portion 3A of FIG. 3.

Referring to FIG. 3, this shows that the containers can be stacked on a pallet, for instance to a depth of five or so containers. Each container can contain about 50 lbs. of fat, and the stacking is permitted in part by the triple-ply construction of the container end walls, as described above, and by the use of corrugated board fluted to provide maximum strength in the vertical direction (if the containers are laid flat).

Referring to FIG. 3, the tubular bags of the present invention can be supplied in connected stacked sheets, similar to computer forms, and the sheets can be separated along tear lines into the individual bags. The bags are sealed along all four edges 54, and are generally rectangular or square in shape when seen from a plan view. On one of the broad sides of the bag, defined as the fill side, there is positioned a fill nozzle 52, to be described. The opposite broad side of the bag is considered the bag support side.

The bag construction is two-ply, comprising an inner low-density polyethylene ply 56, and an outer metallized ply 58, comprising a layer of aluminum foil 60 laminated to a polyester layer 62. The outer ply gives both bag strength and imperviousness to moisture and air penetration. The inner ply has a relatively high melt point so that it can be filled with molten fat without damage to the ply or bag. At the same time, the low-density polyethylene ply is compatible with the fat in the sense that it is resistant to reaction with the fat, such as polymer extraction or breakdown of plastic.

Figure 3B:
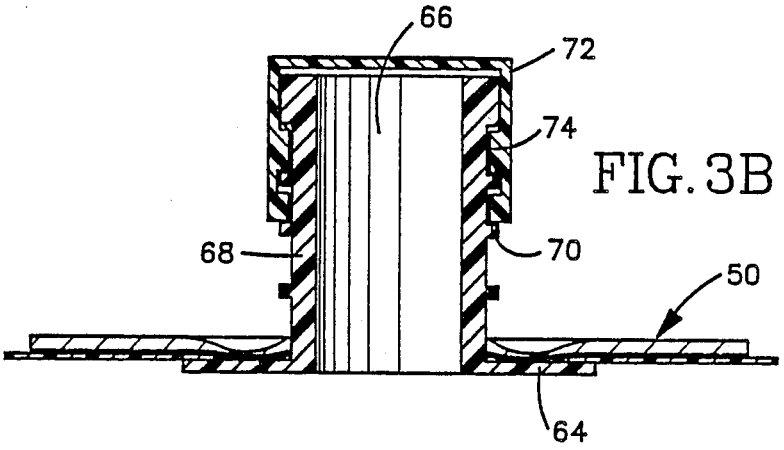
FIG. 3B is an enlarged section view of the bag nozzle.

The neck finish of nozzle 52 is also of low-density polyethylene, the nozzle being in the shape of a hose connection with flange portions 64 (FIG. 3B) heat sealed to the inner low-density polyethylene ply. The design of the fill nozzle is dependent upon the type of fill equipment used, which preferably is automatic. For instance, the fill nozzle can be provided with an inner valve so that when filling of the bag is complete, the fill dispenser can be removed from the nozzle without hard fat flowing from the nozzle. In the embodiment shown, no valve is employed. The nozzle after filling is then capped with a suitable capping device 72, snapped onto the nozzle or into the nozzle, and having a suitable interference fit so that it is held in place.

An advantage of this aspect of the present invention is that the bags can be flushed with nitrogen, or evacuated of air and moisture, prior to filling, for even more extended shelf life of products packaged by the present invention.

In operation, the bags may be filled while positioned in their containers, or positioned on a support platform outside of the containers. However, an important aspect of the present invention is that solidification take place while the bags are positioned in the containers, the broad side of the bag opposite the nozzle side resting on bottom part or panel 12 of the containers, as shown in FIG. 2. During filling, the bag adopts a pillow or pillow-like (e.g., square) configuration, with the sides of the bag being restrained in part by the four side walls of the container. By placing the bags in the containers prior to solidification, they can be readily deformed to fit into the containers. After solidification, if not suitably restrained, the bags would be likely to fit into the containers only with substantial container distortion. Because the containers of the present invention are used for shipping purposes, it is important for the fit to be generally a snug one. In this respect, the function of panel ears 40 and 42 should be apparent. They help prevent the container sides from bowing due to bag pressure, giving the container what can be called bowing strength (resistance to distortion during solidification), as well as stacking strength. It is contemplated that even container stacking can take place prior to product solidification. One of the most important aspects of the present invention is, however, that with adoption by the bag of a pillow-shaped configuration, the fat, when hardened, is essentially free of bag parts imbedded in it. It should be noted that although the pillow-shaped configuration is important, the strength of the bag components also aids in providing an end product substantially free of bag parts.

A potential user, such as a candy manufacturer, can gain access to the fat simply by cutting the bag and pulling it away from the block of hard fat. Alternatively, the fat can be melted in the bag, and poured from the bag, for instance through the fill nozzle. In either event, the difficulty of filtering foreign bag substances from the fat prior to manufacturing an end product such as a candy bar, is avoided, or at least substantially reduced to the point of significantly saving on filtering costs.

Other advantages of the present invention should be apparent. Primarily, as indicated, the present invention is advantageously used with the shipment and storage of solid fats such as hard vegetable fats for food use, where longer shelf life is needed. The construction of the bag is such that it is air and moisture impermeable, considerably adding to the shelf life of products stored in it. Vegetable fats, particularly unsaturated fats, are notoriously sensitive to oxygen and moisture degredation. By the present invention, the shelf life of vegetable fats stored in the packaging of the present invention can be more than doubled, that is increased by as much as six months or more (depending upon the particular fat and degree of unsaturation of the fat). In addition, the use of an inner ply of low-density polyethylene avoids leaching of polymers from the plastic into the fat, a problem confronted in the prior art.

Additional advantages accrue to the present invention. For instance, for shipping, the present invention achieves better utilization of a pallet, because of the rectangular construction of the container, considerably reducing freight costs. Also, the packaging of the present invention is more readily disposed of after use than the plastic pails conventionally used. Also, the fat is more easily or readily released from its packaging without heating than is possible with the plastic pail construction of the prior art.

The present invention is particularly advantageous for use with the shipping and storage of lauric fats which are especially susceptible to moisture and hydrolytic rancidity, as well as oxidative degradation.

In the pactice of the present invention, as described, each container contains a single bag, which preferably holds a predetermined amount of fat, such as fifty pounds. The present invention is equally useful with more than one bag, for instance two bags per container (of twenty five pounds each, by way of example), or three bags. The bags would be placed side-by-side in the container, restrained during solidification on two or three sides by the container, and on the third and/or fourth side by the adjacent bag. It will also be apparent to those skilled in the art that the present invention can be used with meltable products such as hard cheese and rosin.

I claim:

1. A method of packaging a hard fat or hard fat containing product which is normally solid at room temperature comprising the steps of:

heating said product to a molten state;

positioning a rectangular air and moisture impermeable bag having opposed broad sides horizontally on one of its broad sides, said bag comprising flexible multiple plies with one of said plies being metallized and having a fill nozzle on its broad side opposite said one broad side;

at least two opposed edges of said bag being sealed to completely seal said product;

filling said bag while in said horizontal position through said fill nozzle with said product, either while fully molten or partially cooled, but still plastic, to at least a substantially full state and closing said fill nozzle so that said bag adopts a pillow or pillow-like configuration;

placing said bag substantially horizontally in a shipping container on said one broad side, either before filling or after filling, but if after filling, before said product is hardened;

said shipping container having side and end walls confining said bag edges and dimensioned to securely hold said pillow or pillow-like configuration; and allowing said product to cool and solidify while so confined in said container with said bag lying substantially horizontally on said one broad side.

2. The method of claim 1 wherein said bag is 2-ply, having an inner low-density polyethylene ply, and an outer metallized polyester ply, the fill nozzle being sealed to said inner ply.

3. The method of claim 1 wherein said container has multiple plies in at least the side walls thereof and both bowing and stacking strength.

4. The method of claim 1 wherein said container contains one or two bags.

5. The method of claim 1 wherein said molten hard fat or fat-containing product is partially cooled in a heat exchanger and extruded into the bag while still in a plastic state.

6. The method of claim 1 wherein said hard fat or fat containing product is a hard butter.

7. The method of claim 1 wherein said fat or fat-containing product is a lauric fat or lauric fat-containing product.

8. A packaged hard fat or hard fat-containing product which is normally solid at room temperature comprising:

(1) said hard fat or hard fat-containing product;

(2) a sealed rectangular air and moisture impermeable bag comprising flexible multiple plies of which at least one ply is metallized and completely enclosing said product, said bag comprising opposed broad sides, sealed edges connecting said sides together around at least a portion of the perimeter thereof, and a fill nozzle on one of said broad sides, said bag containing said product to at least a substantially full state such that said bag adopts a pillow or pillow-like configuration;

(3) a shipping container containing said bag with said bag lying substantially horizontally on a broad side opposite said one of said broad sides, said shipping container having side and end walls confining said bag edges and dimensioned to securely hold said pillow or pillow-like configuration; and (4) said product having been allowed to solidify while confined in said shipping container with said bag lying substantially horizontally on the side opposite said one of said broad sides such that the fat or fat-containing product is substantially free of bag parts embedded in it.

9. The packaged product of claim 8 wherein said bag is a composite sealed bag, said bag comprising an inner low-density polyethylene ply and an outer metallized polyester ply.

10. The packaged product of claim 9 wherein the bag outer ply is an aluminum foil laminated to a polyester film.

11. The packaged product of claim 8 wherein said product is a lauric fat or lauric fat-containing product.

12. The packaged hard fat or fat containing product of claim 8 wherein said bag is a 2-ply bag impervious to the passage of moisture and air, comprising an inner low-density polyethylene ply and an outer metallized polyester ply, the fill nozzle being sealed to said inner ply.

13. The packaged hard fat or fat containing product of claim 12 wherein said container has multiple plies in walls thereof and bot bowing and stacking strength.

* * * * *

UNITED STATES PATENT AND TRADEMARK OFFICE

CERTIFICATE OF CORRECTION

PATENT NO. : 4,874,621

DATED : October 17, 1989

INVENTOR(S) : Thomas D. Loughrin

It is certified that error appears in the above-identified patent and that said Letters Patent is hereby corrected as shown below:

Column 8, Line 32, Claim 13, change "bot" to --both--.

Signed and Sealed this

Eighteenth Day of December, 1990

*Attest:*

HARRY F. MANBECK, JR.

*Attesting Officer*

*Commissioner of Patents and Trademarks*